United States Patent [19]

Webster et al.

[11] 4,358,414

[45] Nov. 9, 1982

[54] FUEL DELIVERY SYSTEM FOR COMBUSTION DEVICES

[76] Inventors: Sherwood F. Webster, 7832 Via Marina, Scottsdale, Ariz. 85258; Richard L. Heise, 133 E. Garfield, Tempe, Ariz. 85281

[21] Appl. No.: 263,696

[22] Filed: May 14, 1981

Related U.S. Application Data

[63] Continuation-in-part of Ser. No. 98,033, Nov. 28, 1979, Pat. No. 4,285,320.

[51] Int. Cl.[3] ..... F02M 1/08; F02M 29/00

[52] U.S. Cl. ..... 261/53; 123/593; 123/389; 123/442; 123/336; 261/62; 261/44 C; 261/78 R

[58] Field of Search ..... 123/593, 389, 442, 336, 123/378; 261/53, 44 C, 62, 78 R, DIG. 56; 48/180 R

[56] References Cited

U.S. PATENT DOCUMENTS

| | | | |
|---|---|---|---|
| 2,993,484 | 7/1961 | Gallman | 123/389 |
| 3,682,608 | 8/1972 | Hicks | 48/180 R |
| 4,117,046 | 9/1978 | Nohira et al. | 261/44 C |
| 4,153,653 | 5/1979 | Moore | 123/593 |
| 4,187,820 | 2/1980 | Webster et al. | 123/593 |

FOREIGN PATENT DOCUMENTS

| | | | |
|---|---|---|---|
| 55-75531 | 6/1980 | Japan | 123/336 |

*Primary Examiner*—Charles J. Myhre
*Assistant Examiner*—E. Rollins Cross
*Attorney, Agent, or Firm*—B. P. Fishburne, Jr.

[57] ABSTRACT

An air-fuel mixture is delivered at a certain predetermined velocity through a pressure-regulated gate to a dual screen atomizer consisting of a first comparatively coarse mesh screen in contact with a finer mesh screen close to the throat of the gate. The liquid fuel is atomized to uniform size droplets in the small micron range and a homogeneous charge is created in an enlarged plenum downstream from the dual screen atomizer. Pressure in the downstream plenum is reduced in comparison to the pressure existing in the fuel mixture delivery passage upstream from the gate.

10 Claims, 2 Drawing Figures

FUEL DELIVERY SYSTEM FOR COMBUSTION DEVICES

CROSS-REFERENCE TO RELATED APPLICATION

This application is a continuation-in-part of application Ser. No. 098,033, filed Nov. 28, 1979, now U.S. Pat. No. 4,285,320, for VARIABLE CAPACITY FUEL DELIVERY SYSTEM FOR ENGINES.

BACKGROUND OF THE INVENTION

U.S. Pat. No. 4,187,820 and the above-referenced patent application disclose intake manifold fuel atomizing sleeve valves for piston engines whose use results in many benefits including increased fuel economy or mileage, reduced air pollution, much smoother engine operation over a wide RPM range, and others.

The object of the present invention is to provide a pressure regulated air-fuel charge atomization device for a wide range of combustion systems including domestic and industrial heating apparatus, gas turbine engines and power plants and the like.

In accomplishing these aims, a fuel atomization means is provided which will operate efficiently with a wide range of liquid fuels including industrial and home heating oils, kerosenes, gasolines and alcohols.

The system employs an air-fuel charge which can be delivered to the pressure-regulated atomization means by any upstream mixing and metering device in accordance with the prior art. For example, a carburetor may be employed or various fuel injection means to deliver liquid fuel into an air stream may be employed. The fuel mixture is metered through a variable gate at a predetermined velocity, the throat of the gate being automatically adjusted to maintain this velocity by a regulator which senses upstream and downstream fuel charge pressures. The upstream pressure is always greater than the downstream pressure, because of a blocking effect of the atomization means. The downstream plenum for the homogeneous super-atomized charge is enlarged in comparison to the upstream fuel charge delivery passage ahead of the gate.

The atomization means forming the heart of the invention consists of two screens in surface contact with each other immediately adjacent to the rear or downstream side of the adjustable gate and completely spanning the gate throat in all adjusted sizes of the latter. The homogeneous charge in the downstream enlarged plenum contains uniform size fuel particles in the small micron range, and due to the low pressure in the plenum and reduced velocity of the charge therein, any tendency for agglomeration of the charge resulting in surface wetting is substantially eliminated. The plenum downstream from the dual screen atomizer may be a manifold or other chamber means leading to any type of combustion device or forming a part of a combustion space where burning of the atomized fuel charge occurs, as in a jet engine.

Other features and advantages of the invention will become apparent during the coarse of the following detailed description.

DETAILED DESCRIPTION

Figure 2:
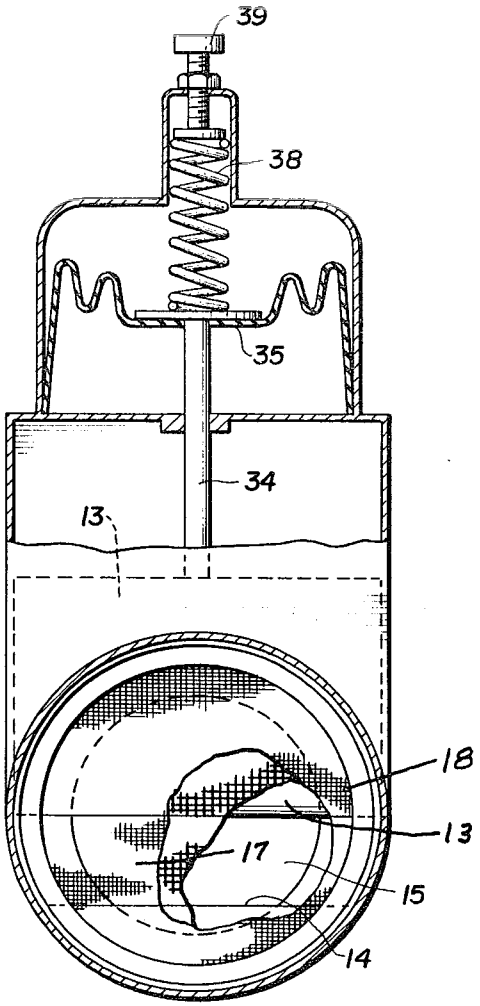
FIG. 2 is a transverse vertical section taken on line 2—2 of FIG. 1.
Figure 1:
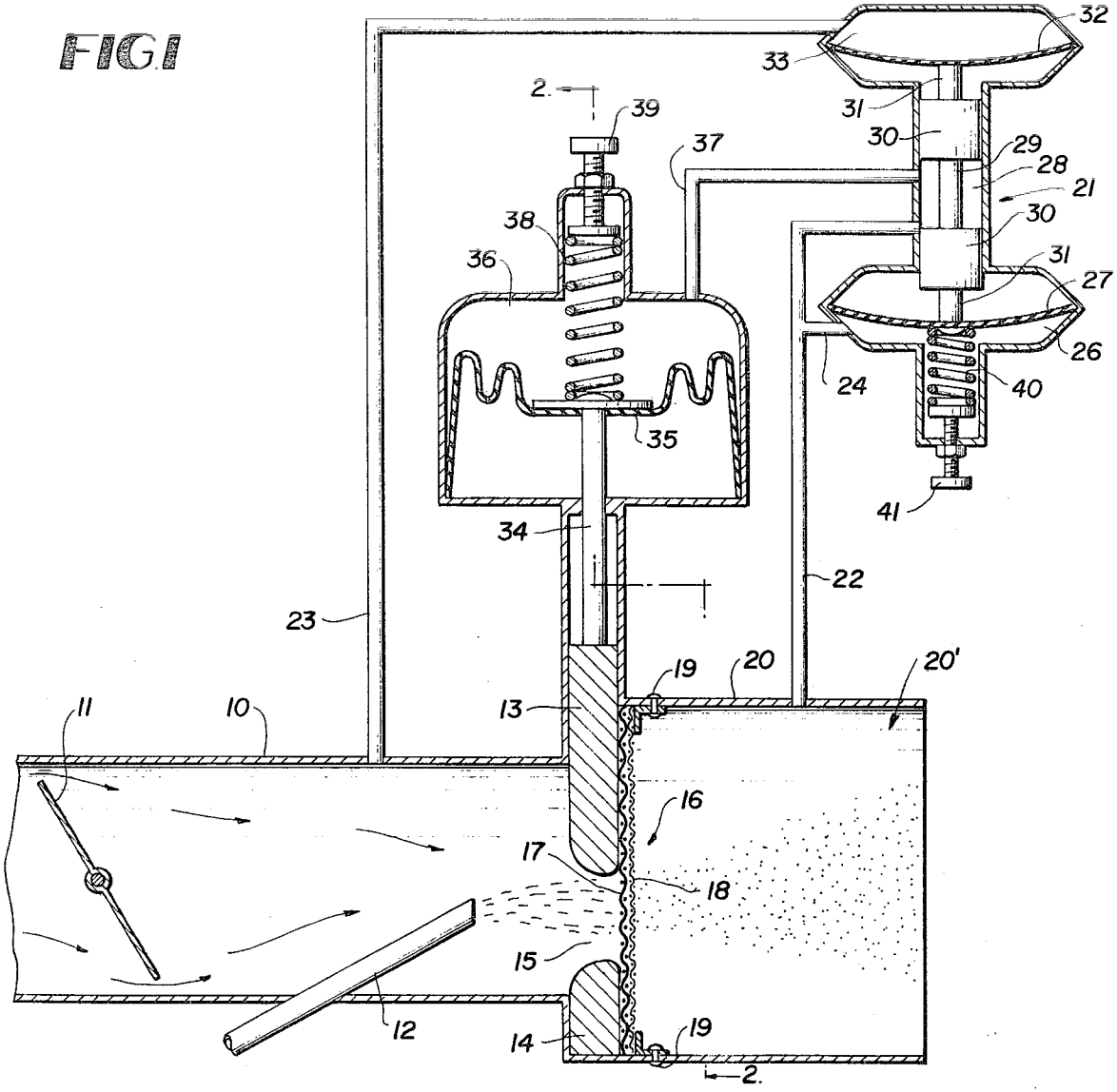
FIG. 1 is a partly cross sectional schematic side elevation of a fuel charge atomization mechanism according to the present invention.

Referring to the drawings in detail wherein like numerals designate like parts, the numeral 10 designates an air-fuel charge delivery chamber or passage, such as the delivery throat of a carburetor or an air delivery conduit of a predetermined cross sectional size and shape. The passage 10 may be equipped with an adjustable throttling device 11, such as a butterfly valve. A suitable liquid fuel delivery tube 12 may be utilized to inject a fuel, such as oil or kerosene, into the passage 10 downstream from the throttling device 11. A plurality of the tubes 12 can be utilized around the perimeter of the passage 10 and other types of liquid fuel delivery means communicating with the passage 10 can be utilized. In all cases, the passage 10 will deliver a mixed charge consisting of air and liquid fuel droplets downstream toward the atomization mechanism forming the main subject matter of the invention.

A pressure-regulated automatically adjustable gate consisting of a movable gate component 13 and an opposing fixed component 14 is arranged across the axis of the fuel charge delivery passage 10 at the downstream end of the latter. The gate components 13 and 14 define a variable width throat 15 through which the mixed charge flows at a predetermined velocity toward a dual atomizing screen assembly 16 forming the heart of the invention. This screen assembly consists of two separate screen elements 17 and 18 arranged in face-to-face contacting relationship over their full areas. The upstream screen 17 is of comparatively coarser mesh in the range of 20–90 mesh whereas the second downstream screen 18 of finer mesh is in the range of 100–300 mesh. The two screens may be formed of stainless steel or other suitable material. The dual screen assembly is located closely adjacent to the downstream side of the adjustable gate, as shown.

The two screen elements 17 and 18 are suitably joined at their peripheries and the screen assembly 16 is attached as at 19 to the wall or walls 20 of a downstream atomized fuel charge plenum 20' or chamber of considerably larger cross sectional size than the upstream delivery passage 10.

In passing through the dual atomizing screen assembly 16, the air-fuel mixture entering the plenum 20' is rendered uniform and homogeneous and the atomized liquid fuel particles are uniform in size and reduced in size to a small micron range. Probably a fuel droplet particle size of substantially less than 20 microns is obtained.

The pressure in the delivery passage 10 is higher than the pressure within the larger plenum 20' because of the retarding or blocking effect of the adjustable gate and the atomizing screen assembly on the charge traveling downstream through the gate and screen assembly. This pressure differential is constantly sensed by a pressure regulator means 21 having a sensing tube 22 in communication with the plenum 20' and another sensing tube 23 in communication with the passage 10.

The sensing tube 22 leads to parallel branches 24 and 25 in communication, respectively, with a chamber 26 below an elastic diaphragm 27 and a cylinder chamber 28 containing a servo-plunger 29. The servo-plunger 29 has two opposite end piston heads 30 within the cylinder chamber 28 and reduced end terminals 31 which are attached to the elastic diaphragm 27 and another diaphragm 32 at the far end of the plunger.

A chamber 33 behind the diaphragm 32 communicates through the tube 23 with the delivery passage 10. The movable gate component 13 is connected through a guided stem 34 with a diaphragm 35 behind which is a chamber 36 in communication through a tube 37 with the cylinder chamber 28 between the two piston heads 30. The diaphragm 36 is opposed by a calibrated spring 38 whose tension may be regulated by an adjuster 39. A similar spring 40 opposes the diaphragm 27 and has its tension regulated by an adjuster 41 so that the pressure regulator 21 can be properly adjusted or calibrated.

In the operation of the system, the regulator constantly senses the pressure differential between the delivery passage 10 and plenum 20' and automatically adjusts the throat 15 of the gate to maintain a predetermined velocity of the fuel charge through the throat. This assures that the fuel charge will impinge on the dual atomizing screen assembly with the correct velocity and energy to enable the two screens to effect the described super-atomization of the charge within the plenum 20'.

The movement or velocity of the atomized charge in the plenum 20' is greatly reduced compared to the upstream velocity and the pressure on the charge in the plenum 20' is reduced. Consequently, there is little or no tendency for agglomeration of the atomized fuel particles and the atomized charge will reach whatever ignition means the combustion system utilizes in the proper state for ideal ignition and burning in a most complete and efficient manner.

As stated, the device can be used to supply an atomized fuel charge to a variety of combustion devices. Also, the invention may utilize a variety of liquid fuels ranging from heating oils through kerosenes and lighter components including gasolines and alcohols.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A fuel delivery system for combustion devices comprising means to deliver air and liquid fuel in one direction including a confining passage, an adjustable valve means across the confining passage, a dual atomizing screen assembly close to the downstream side of the valve means including a comparatively coarse mesh upstream screen element and a finer mesh downstream screen element, the two screen elements lying in contact with each other substantially, a plenum for the atomized homogeneous fuel charge immediately downstream from the dual atomizing screen assembly and being considerably larger in cross sectional size than the confining passage, and a pressure regulator means controlling opening and closing movement of said valve means to maintain a constant velocity of air and liquid fuel through an adjustable throat of the valve means, the pressure regulator means including parts in communication with said plenum and confining passage to constantly sense the pressures therein.

2. A fuel delivery system as defined in claim 1, and said adjustable valve means comprising a gate valve including a movable gate element across the confining passage and having a connection with a movable part of the pressure regulator means.

3. A fuel delivery system as defined in claim 1, and said comparatively coarse mesh screen element being approximately a 20–90 mesh screen and said finer mesh screen element being approximately a 100–300 mesh screen.

4. A fuel delivery system as defined in claim 1, and said confining passage being formed by a delivery conduit of a predetermined cross sectional size and said plenum being formed by a conduit of a substantially larger cross sectional size.

5. A fuel delivery system as defined in claim 4, and said conduits being generally coaxial with said valve means and screen assembly located respectively at the outlet end of the delivery conduit and the inlet end of the larger cross section conduit.

6. A fuel delivery system as defined in claim 5, and a liquid fuel delivery element projecting into said delivery conduit upstream of the valve means.

7. A fuel delivery system as defined in claim 6, and an adjustable throttling element in the delivery conduit upstream of the liquid fuel delivery element.

8. A fuel delivery system as defined in claim 1, and the pressure regulator means comprising a diaphragm sensing unit having a pair of diaphragm chambers in communication with said plenum and confining passage through said parts, said parts comprising a pair of tubes, and a diaphragm responder unit connected with said adjustable valve means and having a diaphragm chamber in communication with an intermediate servo-piston chamber of the diaphragm sensing unit.

9. A fuel delivery system as defined in claim 8, and a movable servo-piston in the servo-piston chamber of the diaphragm sensing unit and being engaged with a pair of opposing elastic diaphragms of the sensing unit within separated diaphragm chambers of such units.

10. A fuel delivery system as defined in claim 9, and means to adjust the sensitivity of the diaphragms of the diaphragm sensing unit and diaphragm responder unit.

* * * * *